US009633625B2

(12) United States Patent
Kumeta et al.

(10) Patent No.: US 9,633,625 B2
(45) Date of Patent: Apr. 25, 2017

(54) PIXEL CIRCUIT AND METHOD FOR DRIVING THE SAME

(71) Applicant: SAMSUNG DISPLAY CO., LTD., Yongin, Gyeonggi-Do (KR)

(72) Inventors: Masayuki Kumeta, Yokohama (JP); Takeshi Okuno, Yokohama (JP); Eiji Kanda, Yokohama (JP); Ryo Ishii, Yokohama (JP); Naoaki Komiya, Yokohama (JP)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 345 days.

(21) Appl. No.: 14/283,654

(22) Filed: May 21, 2014

(65) Prior Publication Data

US 2014/0347405 A1 Nov. 27, 2014

(30) Foreign Application Priority Data

May 22, 2013 (JP) ..... 2013-107814
Apr. 22, 2014 (KR) ..... 10-2014-0048156

(51) Int. Cl.
*G09G 3/32* (2016.01)
*G09G 5/10* (2006.01)
*G09G 3/3233* (2016.01)

(52) U.S. Cl.
CPC ..... *G09G 5/10* (2013.01); *G09G 3/3233* (2013.01); *G09G 2300/0814* (2013.01); *G09G 2300/0861* (2013.01)

(58) Field of Classification Search
CPC ... G09G 2300/0814; G09G 2300/0861; G09G 3/3233; G09G 5/10
See application file for complete search history.

(56) References Cited

U.S. PATENT DOCUMENTS

2008/0150846 A1 6/2008 Chung
2008/0165302 A1 7/2008 Yasui et al.
2012/0182283 A1* 7/2012 Park ..... G09G 3/3266 345/212

FOREIGN PATENT DOCUMENTS

JP 04251818 A * 9/1992
JP 2005-157283 6/2005
JP 2006189473 A 7/2006
JP 2007-010872 1/2007
JP 2008-175945 7/2008
JP 2008158477 A 7/2008
JP 2010-044370 2/2010
JP 2010-541014 12/2010
(Continued)

*Primary Examiner* — Latanya Bibbins
(74) *Attorney, Agent, or Firm* — Lee & Morse, P.C.

(57) ABSTRACT

A pixel circuit includes a plurality of pixels. Each pixel includes a data storage capacitor to store a voltage for controlling a gray scale value based on an input data signal, a plurality of switch transistors connected in series between a data signal line and the data storage capacitor, and a plurality of connection transistors coupled to the pixels. The switch transistors have a gate electrode connected to a first gate control signal line. At least one connection transistor is connected between at least one node between the switch transistors of a first pixel and at least one node between the switch transistors of a second pixel adjacent to the first pixel. The at least one connection transistor includes a gate electrode connected to a second gate control signal line.

20 Claims, 13 Drawing Sheets

(56) References Cited

FOREIGN PATENT DOCUMENTS

| | | |
|---|---|---|
| JP | 2011-145622 A | 7/2011 |
| JP | 2011-191449 | 9/2011 |

* cited by examiner

PIXEL CIRCUIT AND METHOD FOR DRIVING THE SAME

CROSS-REFERENCE TO RELATED APPLICATION

Japanese Patent Application No. 2013-107814, filed on May 22, 2013, and Korean Patent Application No. 10-2014-0048156, filed on Apr. 22, 2014, and entitled, "Pixel Circuit and Method for Driving the Same," are incorporated by reference herein in their entirety.

BACKGROUND

1. Field

One or more embodiments described herein relate to a display device.

2. Description of the Related Art

A variety of flat panel displays have been developed. Examples include an organic light-emitting display and a liquid crystal display. A pixel of a liquid crystal display typically includes a liquid crystal capacitor and data storage capacitor. A pixel of an organic light-emitting display typically includes an emission element, a driving transistor, a switching transistor, and a data storage capacitor.

In operation, gray scale data controls the brightness of light to be emitted from each pixel. Once written, the gray scale data is kept until next gray scale data is to be written. If an off leakage current occurs at a switching transistor of a pixel provided with a gray scale value, a voltage applied to the pixel may vary with time. As a result, a flicker phenomenon may occur or a variation in brightness of the pixel may result.

SUMMARY

In accordance with one embodiment, a pixel circuit includes a plurality of pixels. Each of the pixels include a data storage capacitor to store a voltage for controlling a gray scale value based on an input data signal, a plurality of switch transistors connected in series between a data signal line and the data storage capacitor, each of the switch transistors including a gate electrode connected to a first gate control signal line; and a plurality of connection transistors coupled to the pixels, wherein at least one of the connection transistors is connected between at least one node between the switch transistors of a first pixel and at least one node between the switch transistors of a second pixel adjacent to the first pixel, and wherein the at least one connection transistor includes a gate electrode connected to a second gate control signal line.

The at least one node of each of the first and second pixels may be connected to a power supply voltage line having a predetermined voltage via respective ones of the connection transistors.

Each of the first and second pixels may include a driving transistor having a gate electrode to receive a voltage charged in the data storage capacitor, the driving transistor to adjust an amount of input current to be supplied to an emission element; and an emission transistor connected between the driving transistor and emission element and controlled with connection transistor, the emission transistor to control the input current to be supplied to the emission element. The plurality of switch transistors may include a first switch transistor connected between a first signal line and the data storage capacitor, and a second switch transistor connected between a second signal line and the data storage capacitor, wherein the first and second switch transistors are connected to the at least one node, and wherein the connection transistor is turned off during a turn-on period of the first and second switch transistors and is turned on during at least a period after the first and second switch transistors are turned off.

In accordance with another embodiment, a method of driving a display device includes turning on switch transistors of a first pixel after a connection transistor of the first pixel is turned off; and turning on the connection transistor after the switch transistors are turned off, wherein the switch transistors are coupled in series between a driving transistor and a data line of the first pixel, wherein the connection transistor is coupled to a node between the switch transistors of the first pixel and a node between switch transistors of a second pixel adjacent the first pixel.

The nodes of the first and second pixels may be connected to a power supply voltage line having a predetermined voltage during a turn-on period of the connection transistor. The nodes of the first and second pixels may be connected to a power supply voltage line having a predetermined voltage via the connection transistor.

Each of the first and second pixels may include a driving transistor having a gate electrode to receive a voltage charged in a data storage capacitor, the driving transistor to adjust an amount of input current to be supplied to an emission element; and an emission transistor connected between the driving transistor and the emission element and controlled with the connection transistor, the emission transistor controlling the input current to be supplied to the emission element, wherein the emission transistor is turned on with the switch transistors and is turned off with the switch transistors.

The switch transistors in the first pixel may include a first switch transistor connected between a first signal line and a data storage capacitor, and a second switch transistor connected between a second signal line and the data storage capacitor, the first and second switch transistors are connected to the node of the first pixel, and the first switch transistor is turned on after the connection transistor is turned off, the second switch transistor is turned on after the first switch transistor is turned off, and the connection transistor is turned on after the second switch transistor is turned off.

In accordance with another embodiment, a pixel includes a first transistor coupled between a node and an emission area; and a second transistor coupled between the node and a data line, wherein the first and second transistors are controlled by a control signal, wherein the node is coupled to a reference power supply voltage, and wherein leakage current of at least one of the first or second transistors is controlled by the reference power supply voltage when the first and second transistors are set to an off state by the control signal.

The emission area may include an organic light emitting diode and a driving transistor to control the organic light emitting diode. The emission area may include a liquid crystal layer. The node may be coupled to a node between switch transistors of another pixel. The reference power supply voltage may be based on an average of data values to be written into at least two pixels.

In accordance with another embodiment, a pixel circuit includes a first pixel; a second pixel adjacent to the first pixel; and a connection transistor between the first and second pixels, wherein each of the first and second pixels includes a first transistor coupled between a node and an emission area and a second transistor coupled between the node and a data line, wherein the first and second transistors are controlled by a first control signal and the connection transistor is controlled by a second control signal, and wherein the node of the first pixel is coupled to the node of the second pixel through the connection transistor, and the node of the second pixel is coupled to a reference power supply voltage.

In each of the first and second pixels, leakage current of at least one of the first or second transistors may be controlled by the reference power supply voltage when the first and second transistors are set to an off state by the first control signal. The first control signal may be a scan signal and the second control signal may be an emission signal. In each of the first and second pixels, the first and second transistors may be in an off state when the connection transistor is in an on state.

The emission area of each of the first and second pixels may include an organic light emitting diode and a driving transistor to control the organic light emitting diode. The emission area of each of the first and second pixels may include a liquid crystal layer. The reference power supply voltage may be based on an average of data values to be written in at least the first and second pixels.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
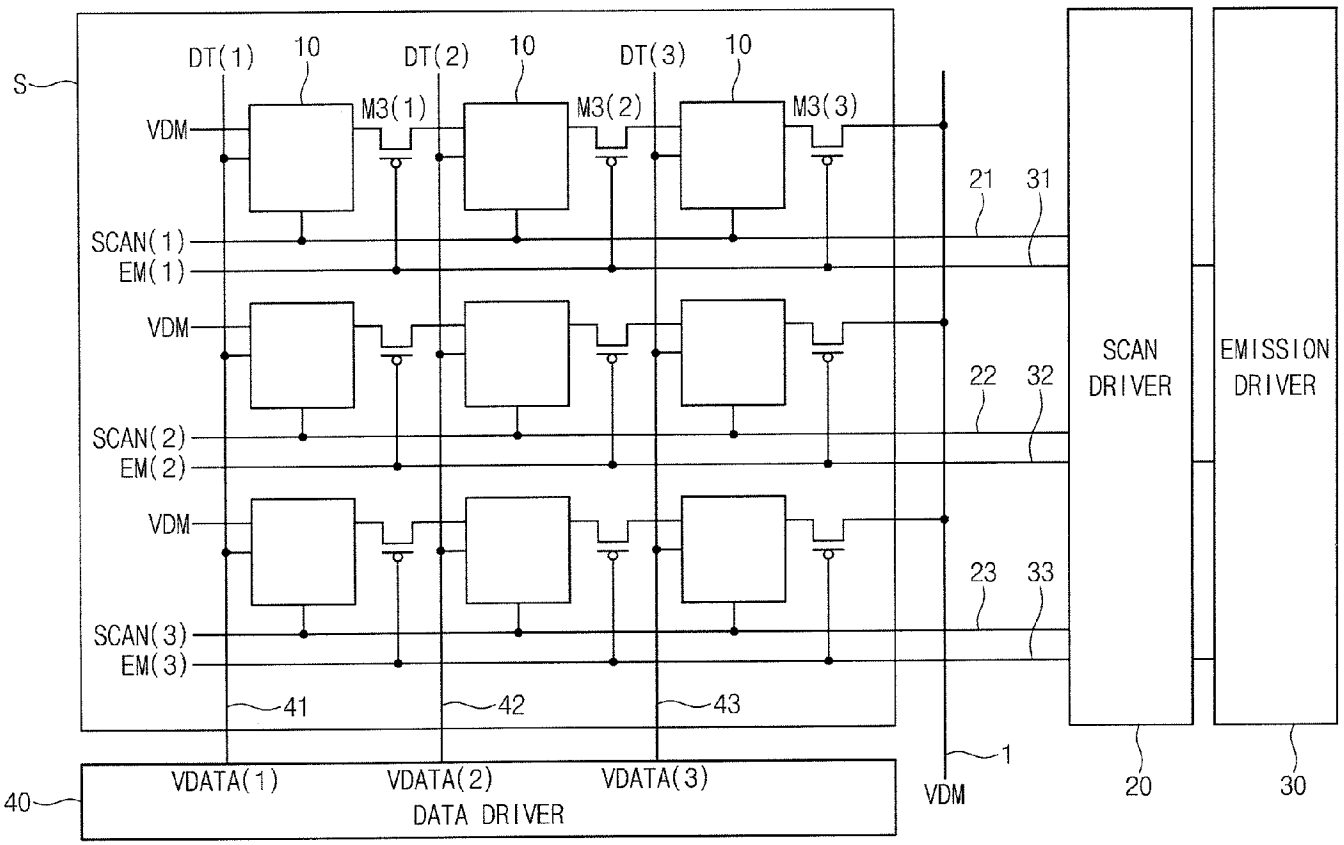
FIG. 1 illustrates an embodiment of a light-emitting display device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

FIG. 1 illustrates an embodiment of a light emitting display device which includes a pixel circuit 5 which includes plurality of pixels 10 arranged in an n×m matrix. The pixels 10 are controlled by a scan driver 20, an emission driver 30, and a data driver 40. Here, n=1, 2, 3 . . . and m=1, 2, 3 . . . . For example, if n=3, a pixel circuit group in a third row may be addressed. If m=3, a pixel circuit group in a third column may be addressed. In FIG. 1, pixel circuits are arranged in a 3×3 matrix. In other embodiments, the values of n and/or m may be different to correspond to a different size matrix.

Scan driver 20 is a driving circuit that selects a row where a data signal is written or applied. The scan driver 20 supplies a gate control signal SCAN(n) to gate control signal lines 21, 22, and 23, which correspond to rows of pixel circuits. In one embodiment, selection is sequentially and exclusively made according to a predetermined order for every row.

Emission driver 30 controls the timing of when a signal is supplied to an emission element, and supplies emission control signals EM(n) to emission control signal lines 31, 32, and 33 corresponding to rows of pixels 10. When gate control signal lines 21, 22, and 23 are defined as first gate control signal lines, emission control signal lines 31, 32, and 33 are defined as second gate control signal lines.

Data driver 40 decides a gray scale value based on input image data, supplies a data signal corresponding to the gray scale value to each of the pixels 10, supplies a data signals DT(m) to data signal lines 41, 42, and 43 corresponding to columns of pixels 10, and writes a data value VDATA(n) at each of pixels 10.

In one embodiment, pixels 10 in each row are connected to a reference power supply voltage VDM. Connection transistors M3(*m*) (e.g., a transistor connected between adjacent pixels) are controlled by respective emission control signals EM(n) from emission driver 30. The connection transistors M3(*m*) are connected between adjacent pixels 10, and between a pixel 10 and reference power supply voltage VDM.

Figure 2:
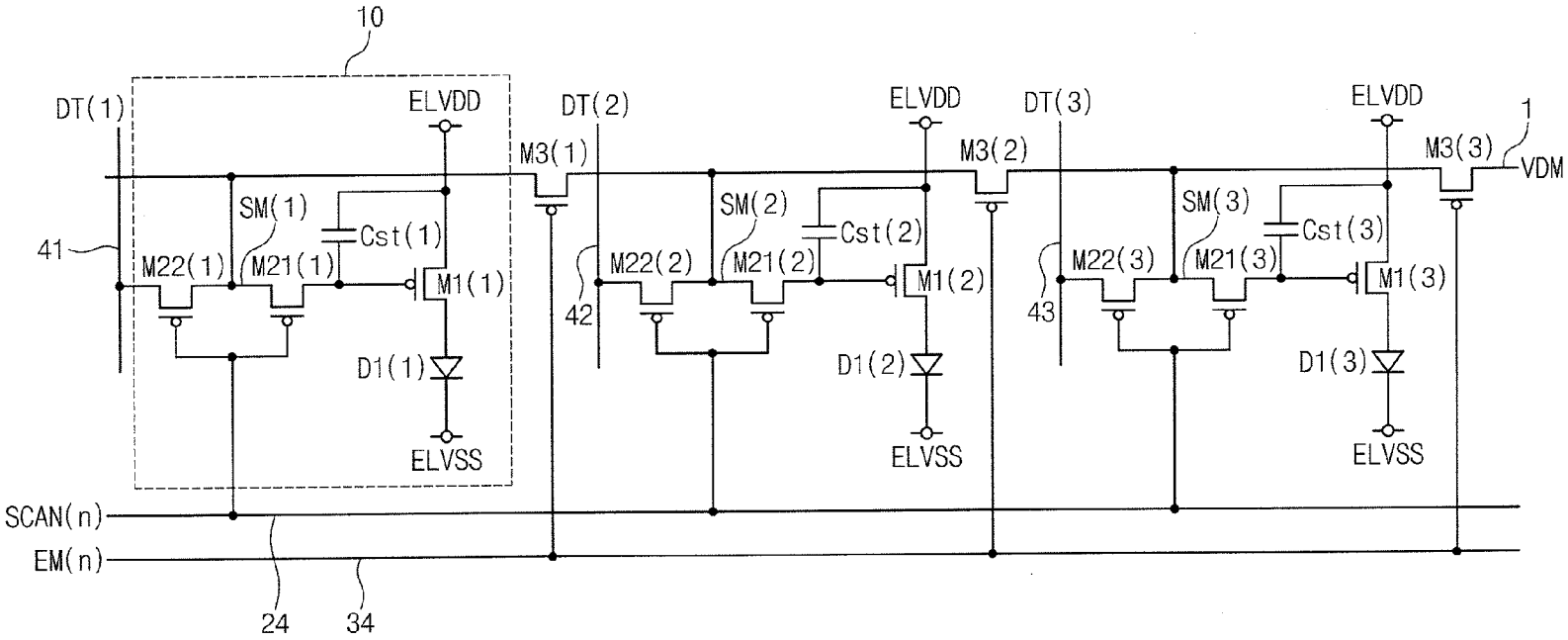
FIG. 2 illustrates an embodiment of a pixel circuits in a row.

FIG. 2 illustrates an embodiment of pixel 10 in an nth row, where the pixels are formed to include p-channel transistors. Pixel 10 is formed of an anode power supply voltage ELVDD, a cathode power supply voltage ELVSS, a driving transistor M1(*m*), switch transistors M21(*m*) and M22(*m*), a capacitive element Cst(m) (or, a storage capacitor), and an emission element D1(*m*). The capacitance for storing a voltage corresponding to a data signal may include the capacitive element Cst(m), parasitic capacitance of the switch transistor, and parasitic capacitance between lines. Thus, in this embodiment, each pixel includes four transistors and one capacitive element.

The relationship between elements of each pixel will be described using a pixel 10 disposed at a first column (m=1). One of a source electrode or a drain electrode of driving transistor M1(1) is connected to anode power supply voltage ELVDD. The other of the source electrode or the drain electrode is connected to an anode electrode of emission element D1(1). A gate electrode of driving transistor M1(1) is connected to one electrode of capacitive element Cst(1). The switch transistors M21(1) and M22(1) are connected in series between the gate electrode of driving transistor M1(1) and a data signal line 41. The other electrode of capacitive element Cst(1) is connected to an anode power supply voltage ELVDD. A cathode electrode of emission element D1(1) is connected to a cathode power supply voltage ELVSS.

The switch transistors M21(1) and M22(1) are controlled by gate control signal SCAN(n) supplied through a gate control signal line 24. The switch transistors M21(1) and M22(1) include two transistors M21(1) and M22(1), which are simultaneously controlled by gate control signal SCAN (n) supplied through gate control signal line 24.

A node SM(1) between transistors M21(1) and M22(1) is connected to a node SM(2) between two transistors M21(2) and M22(2) of switch transistors M21(2) and M22(2) of an adjacent pixel 10 through connection transistor M3(1). The nodes are connected to a reference power supply voltage VDM at an end of a pixel circuit. Also, connection transistors M3(1), M3(2), and M3(3) are simultaneously controlled by an emission control signal EM(n), transferred via emission control signal line 34.

Figure 3:
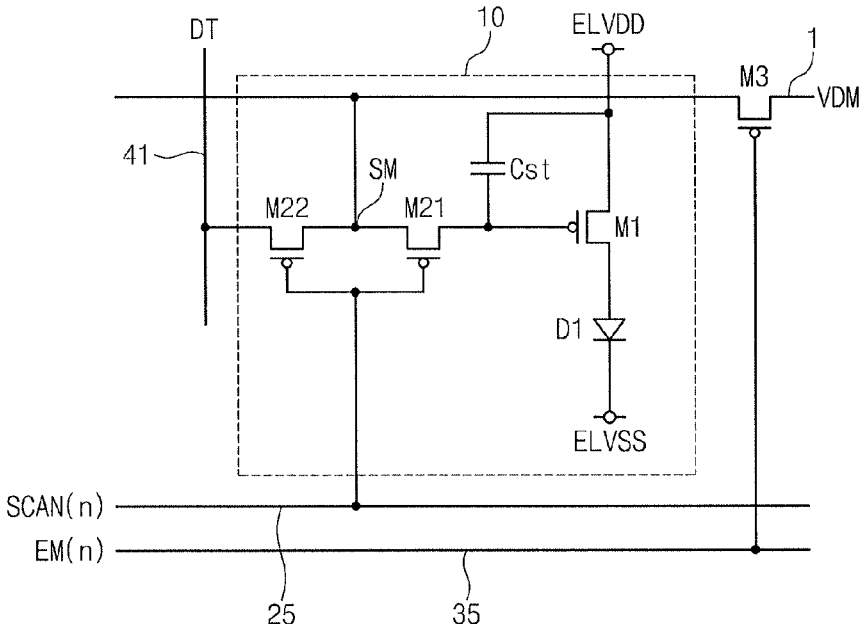
FIG. 3 illustrates an embodiment of a pixel.
Figure 4:
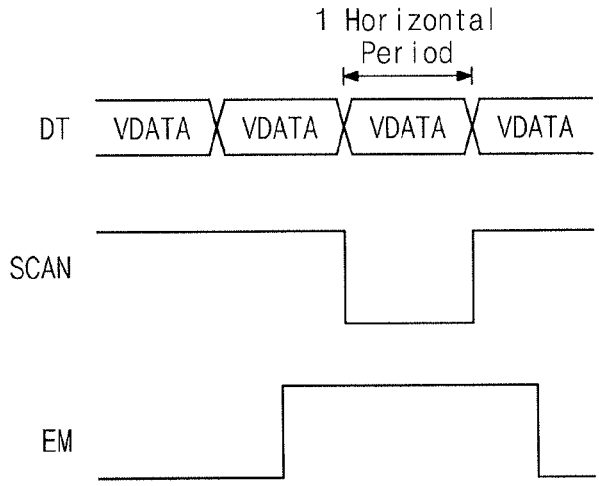
FIG. 4 illustrates an embodiment of signals for controlling a pixel.

FIG. 3 illustrates an embodiment of pixel 10, which, for example, may correspond to a pixel in FIGS. 1 and 2. FIG. 4 illustrates a timing diagram for operating the pixel in FIG. 3. Signals for operating pixel 10 may be voltage signals indicating logical levels, such as a low level and a high level. Also, a conducted transistor may mean that a transistor is turned on, and a non-conducted transistor may mean that a transistor is turned off.

Referring to FIGS. 3 and 4, first, after a connection transistor is turned off in response to an emission control signal EM from emission control signal line 35, a gate control signal SCAN supplied to a gate control signal line 25 transitions to a low level. At this time, switch transistors M21 and M22 turn on. As data signal DT is supplied to a gate electrode of a driving transistor M1, via a data line 41, a data value DATA corresponding to a data signal is charged in capacitive element Cst. Thus, gray scale data is written in pixel 10. The emission control signal EM has a high level during a data write period (e.g., a period where gate control signal SCAN has a low level and transistors M21 and M22 are turned on), and a connection transistor M3 is turned off.

In FIG. 4, an example of timing is illustrated for when emission control signal EM transitions to a high level (or when connection transistor M3 is turned off). This timing is earlier than a timing of when gate control signal SCAN transitions to a low level (or, switch transistors M21 and M22 are turned on). In another embodiment, these timings may coincide with each other.

When gate control signal SCAN transitions to a high level, switch transistors M21 and M22 are turned off to stop supply of data signal DT. Writing of gray scale value data is therefore completed.

As emission control signal EM transitions to a low level after writing of the gray scale value data, connection transistor M3 is turned on. At this time, nodes SM among adjacent pixels 10 are interconnected to one another and connected to the reference power supply voltage VDM.

In one embodiment, a potential of reference power supply voltage VDM may be set to an average value of a maximum value and a minimum value of data values to be written at the same row. In other embodiments, a potential of the reference power supply voltage VDM may be set to an average of all data values to be written at the same row, or to an average value of data values to be written at all pixels.

In one embodiment, because nodes SM among adjacent pixels are connected to one another and to reference power supply voltage VDM, influence forced to a potential a gate electrode of driving transistor M1 may be reduced. However, an off leakage current may be generated because of variation in a voltage of data signal DT connected to one transistor M22. Thus, it is possible to prevent or reduce the likelihood of deterioration of image quality due to crosstalk.

Because node SM of switch transistors M21 and M22 is connected to reference power supply voltage VDM, charges on node SM are fixed to reference power supply voltage VDM just after writing of gray scale data is completed. In this case, because a potential difference between source and drain electrodes of transistor M21 of switch transistors M21 and M22 decreases, off leakage current of transistor M21 is hardly generated. Thus, driving transistor M1 may operate stably.

In operation of the pixel, when one transistor M22 of switch transistors M21 and M22 is not selected, influence of voltage variation of data signal DT on a gate electrode of driving transistor M1 is suppressed, so driving transistor M1 operates stably.

These and other effects one or more of the aforementioned embodiments may be understood based on comparison to another type of pixel operation which has been proposed.

Figure 5A:
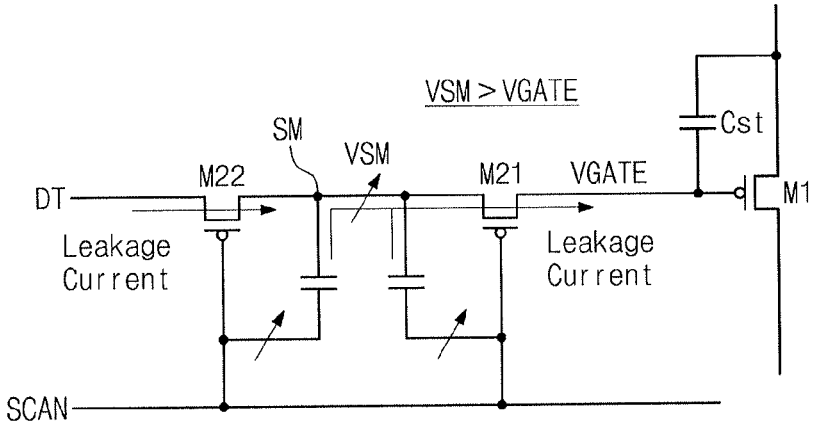
FIG. 5A illustrates one type of pixel operation that has been proposed.
Figure 5B:
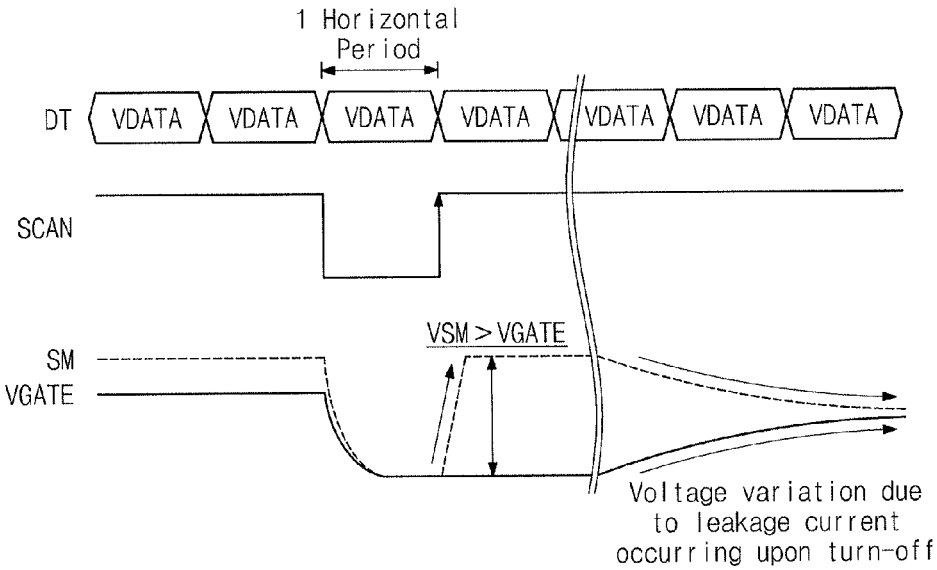
FIG. 5B illustrates voltage variation for the pixel operation in FIG. 5A.

FIG. 5A illustrates voltage variation occurring during operation of another type of pixel. As illustrated in FIG. 5A, a node SM between transistors M21 and M22 (e.g., switch transistors) is not connected to a node SM of an adjacent pixel and to a reference power supply voltage VDM. When switch transistors M21 and M22 are turned off in response to a high level of a gate control signal SCAN, a potential of node SM between transistors M21 and M22 increases due to influence of charges accumulated as a result of a parasitic capacitance of switch transistors M21 and M22. For example, a potential VSM of node SM may be greater than a potential VGATE of a gate electrode of a driving transistor M1. In this case, a current flows from node SM to the gate electrode of driving transistor M1, as a result of off leakage current of switch transistor M21. A potential of the gate electrode of driving transistor M1 may therefore vary.

Also, if a data signal is supplied to transistor M22 of unselected switch transistors M21 and M22, a potential VSM of node SM or a potential VGATE of the gate electrode of driving transistor M1 may vary as a result of the off leakage current of transistor M22.

Figure 6A:
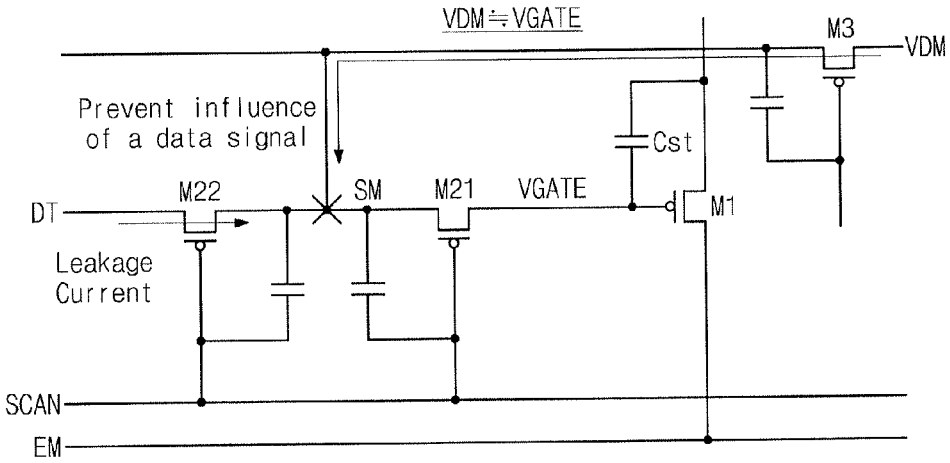
FIG. 6A illustrates operation of a pixel circuit according to one embodiment.
Figure 6B:
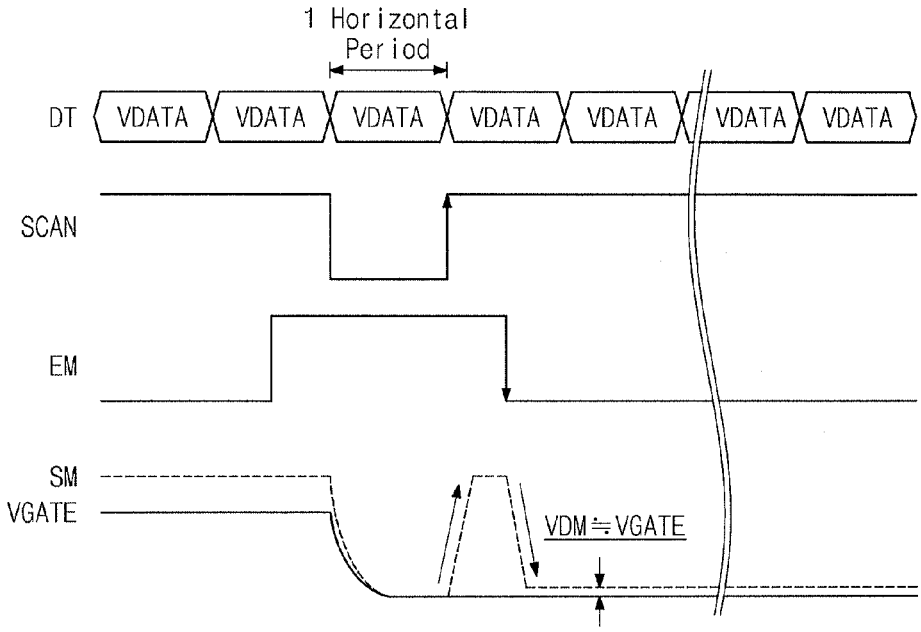
FIG. 6B illustrates voltage variation for the pixel circuit in FIG. 6A.

FIG. 6A illustrates an embodiment of operation of a pixel circuit according to one embodiment, and FIG. 6B illustrates a voltage variation occurring during operation of this pixel circuit.

In this embodiment, node SM between transistors M21 and M22 is connected to a reference power supply voltage VDM through connection transistor M3. The reference power supply voltage VDM may be set to be substantially the same as a potential VGATE of a gate electrode of driving transistor M1. As an emission control signal EM transitions to a high level, connection transistor M3 turns off. Next, as a gate control signal SCAN transitions to a low level, switch transistors M21 and M22 are turned on.

After switch transistors M21 and M22 turn off according to a low-to-high transition of gate control signal SCAN, connection transistor M3 turns on in response to a high-to-low transition of emission control signal EM. When switch transistors M21 and M22 turn off, a potential of node SM increases due to influence of charges stored by parasitic capacitance of switch transistors M21 and M22. However, because connection transistor M3 is turned on, node SM is connected to reference power supply voltage VDM. Thus, a potential of node SM is fixed to a potential of the gate electrode of the driving transistor M1 supplied from reference power supply voltage VDM.

The off leakage current therefore hardly flows, if at all. This is because a potential difference between source and drain electrodes of transistor M21 of switch transistors M21 and M22 hardly occurs. Although off leakage current is generated at transistor M21, a data signal does not affect a potential of the gate electrode of driving transistor M1. This is because node SM between switch transistors M21 and M22 is fixed to the reference power supply voltage VDM.

Thus, in accordance with at least one embodiment, it is possible to suppress variation in a gate voltage of a driving transistor as a result of off leakage current of a switch transistor, by adding a small number of additional elements and lines. Also, it is possible to suppress a change in gate voltage of the driving transistor due to variation in voltage of the data signal line. The size of a capacitive element used as a data storage capacitor may also be substantially reduced, thereby improving opening ratio and promoting miniaturization.

Figure 7:
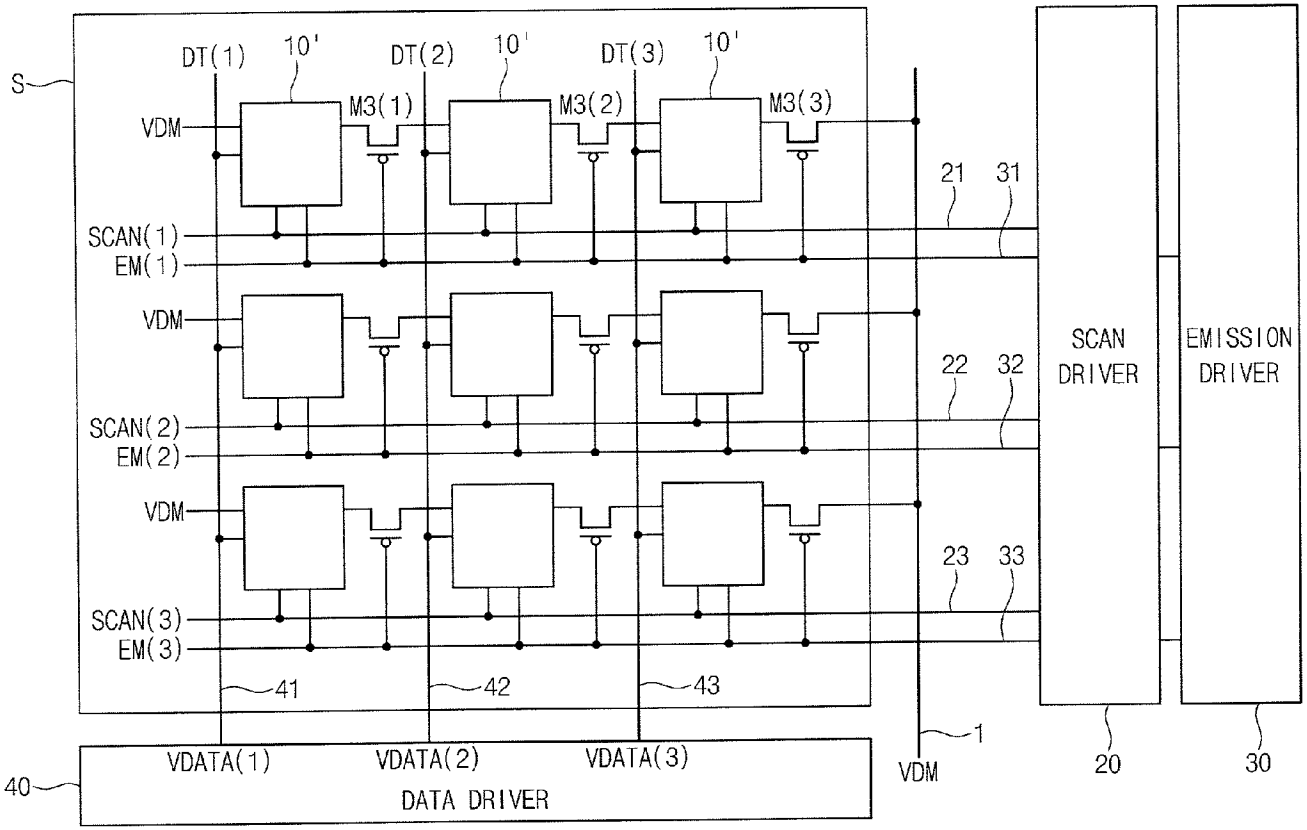
FIG. 7 illustrates an embodiment of a light-emitting display device.
Figure 8:
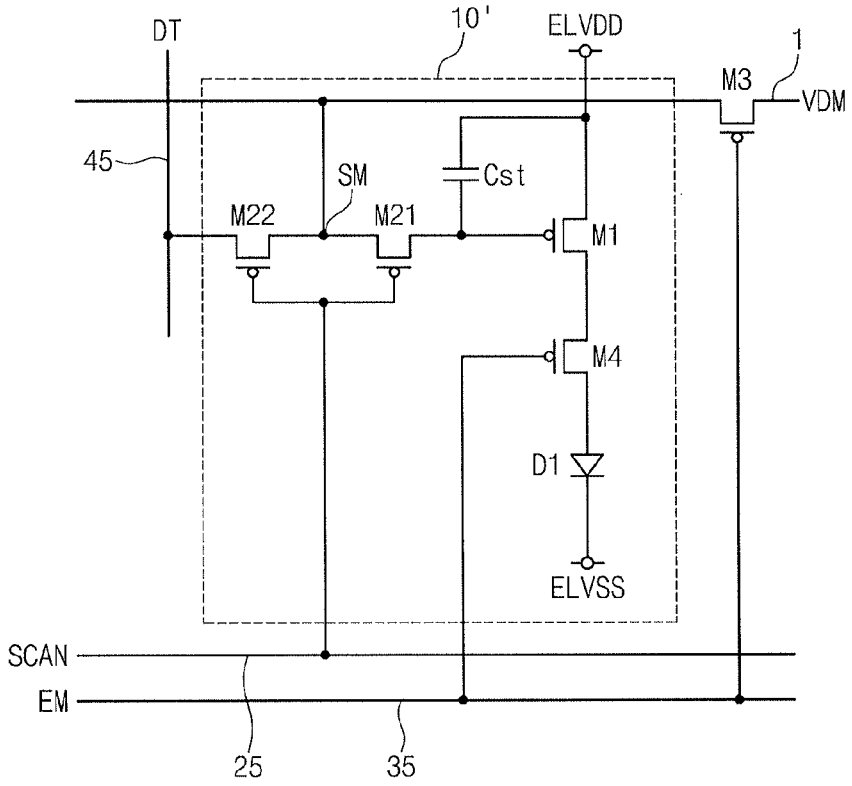
FIG. 8 illustrates another embodiment of a pixel.

FIG. 7 illustrates another embodiment of a light emitting display device which includes a plurality of pixels 10'. The display device in FIG. 7 is different from FIG. 1 in that emission control signal EM(n) is supplied to connection transistor M3 and each pixel 10' via emission control signal lines 31, 32, and 33 connected to emission driver 30. FIG. 8 illustrates an embodiment of pixel 10', and FIG. 9 illustrates a timing diagram for operating pixel 10'.

As compared with pixel 10 in FIG. 3, the pixel 10' in FIG. 8 includes an emission transistor M4. Source and drain electrodes of emission transistor M4 are connected to driving transistor M1 and emission element D1, respectively. The gate electrode of emission transistor M4 is connected to emission control signal line 35. Connection transistor M3 and emission transistor M4 are simultaneously controlled by emission control signal EM. In this embodiment, it is therefore possible to control emission without adding a new control signal line. The emission transistor M4 switches a current path between emission transistor M4 and emission element D1.

Figure 9:
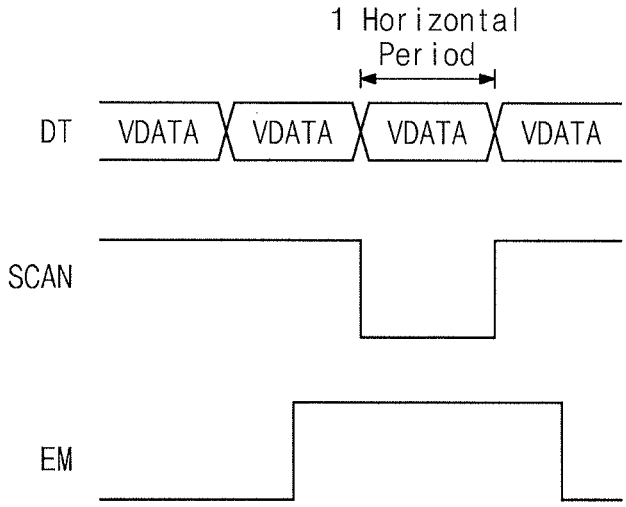
FIG. 9 illustrates another embodiment of signals for controlling a pixel.

As illustrated in FIG. 9, first, when emission control signal EM transitions to a high level, transistors M3 and M4 are turned off. Afterwards, as a gate control signal SCAN transitions to a low level, transistors M21 and M22 turn on at the same time. Data signal DT is supplied to the gate electrode of driving transistor M1 via data signal line 45. Gray scale data is written at the pixel by charging capacitive element Cst with data value VDATA corresponding to data signal DT.

The emission control signal EM has a high level during a data write period (e.g., a period where gate control signal SCAN has a low level and transistors M21 and M22 turn on). Transistors M3 and M4 are turned off, nodes SM of adjacent pixels are not connected, and the emission element D1 does not emit light.

FIG. 9 illustrates an example where emission control signal EM transitions to a high level (or when connection transistor M3 and emission transistor M4 are turned off) is earlier than a timing of when gate control signal SCAN transitions to a low level (or, switch transistors M21 and M22 turn on). In other embodiments these timings may coincide with each other.

When gate control signal SCAN transitions to a high level, switch transistors M21 and M22 turn off. A supply of data signal DT is stopped, and writing of gray scale data is ended. As emission control signal EM transitions to a low level after writing of gray scale data is completed, connection transistor M3 and emission transistor M4 are turned on, and nodes SM of adjacent pixels are connected to one another and to reference power supply voltage VDM. At the same time, emission element D1 emits light by supplying an anode power supply voltage ELVDD to emission element D1.

FIG. 9 illustrates an example where emission control signal EM transitions to a low level (or connection transistor M3 and emission transistor M4 are turned on) later than when gate control signal SCAN transitions to a high level (or, switch transistors M21 and M22 are turned off). In other embodiments, these timings may coincide with each other.

As described above, gate control signal. SCAN is provided in common to control on/off states of connection and emission transistors M3 and M4 at the same time. This embodiment, therefore, does not require the addition of a new control signal line. As a result, the size of each pixel may be reduced and its opening ratio improved. In other embodiments, the connection and emission transistors M3 and M4 may be controlled using independent gate control signals.

Additionally, because a new control signal line does not have to be added for control of a duty ratio or for blocking of light emitting at a data write operation, the size of the pixel may be reduced and the opening ratio of each pixel is improved. Also, off leakage current may be reduced.

Figure 10:
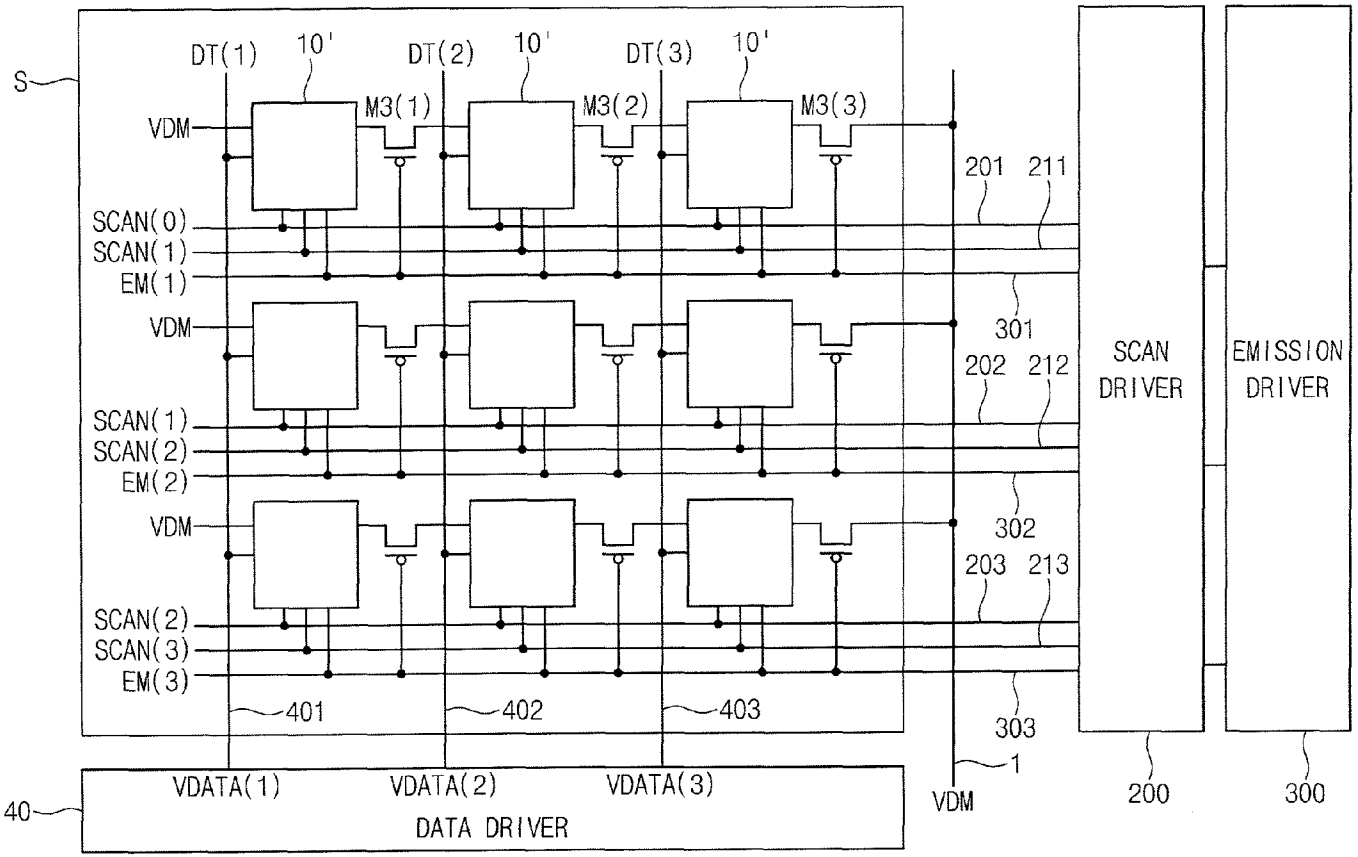
FIG. 10 illustrates another embodiment of a light-emitting display device.

FIG. 10 illustrates another embodiment of a light emitting display device which includes a plurality of pixels 10". The display device in FIG. 10 is different from FIG. 1 in that an emission control signal EM(n) is supplied to connection transistor M3 and each pixel via emission control signal lines 301, 302, and 303, which are connected to emission driver 30. Also, gate control signals SCAN(n−1) and SCAN (n) are supplied to each pixel via gate control signal lines 201, 202, 203, 211, 212, and 213, which are connected to scan driver 200.

Figure 11:
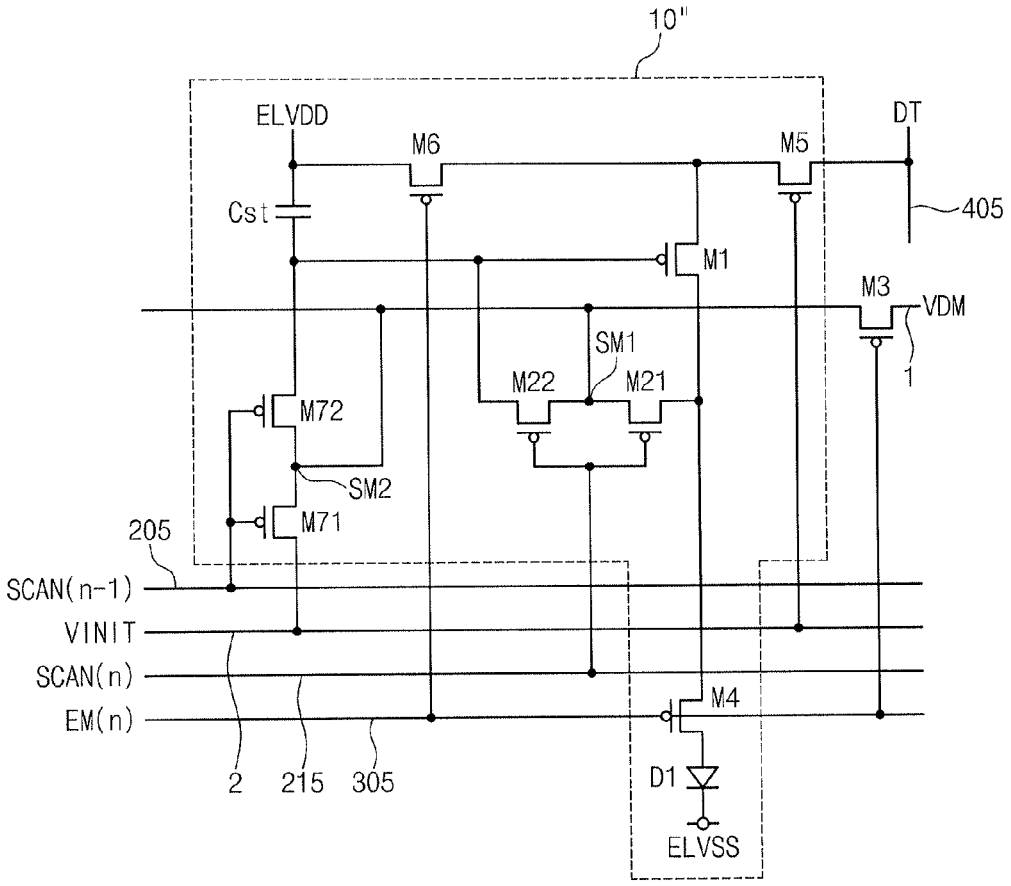
FIG. 11 illustrates another embodiment of a pixel.
Figure 12:
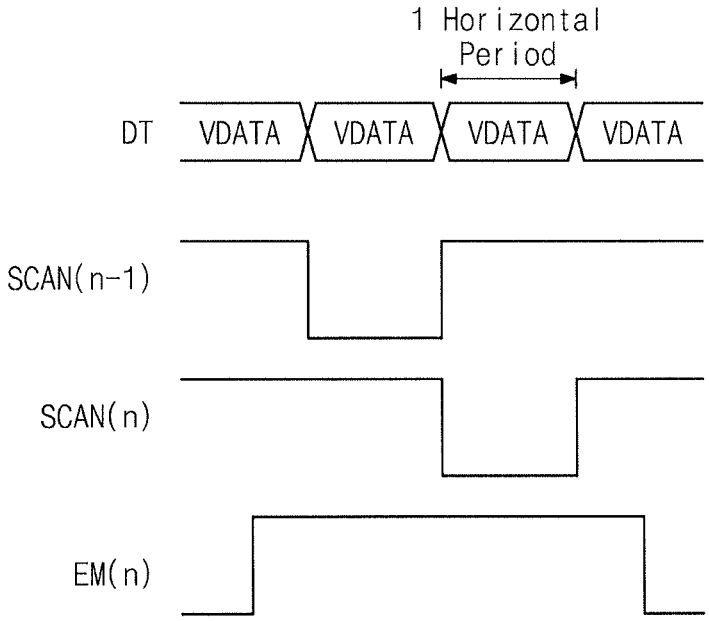
FIG. 12 illustrates another embodiment of signals for controlling a pixel.

FIG. 11 illustrates an embodiment of pixel 10", and FIG. 12 illustrates a timing diagram for operating this pixel.

As illustrated in FIG. 11, pixel 10" includes driving transistor M1, switch transistors M21, M22, M5, M71, and M72, emission transistors M4 and M6, a connection transistor M3, a capacitive element Cst, and emission element D1. The connection transistor M3 connects a node SM1 (a first node) of pixel 10" and a node SM1 of an adjacent pixel, and a node SM2 (second node) of pixel 10" and a node SM2 of the adjacent pixel. The pixel 10 is connected to an anode power supply voltage ELVDD, data signal line 405, gate control signal lines 205 and 215, initialization signal line 2, and emission control signal line 305. A data storage capacitor may include, but is not limited to, capacitive element Cst, parasitic capacitance of a switch transistor, and parasitic capacitance between various lines.

The anode power supply voltage ELVDD in FIG. 11 illustrates a power supply voltage of an anode of emission element D1 in an emission period. A cathode power supply voltage ELVSS is a power supply voltage of a cathode of emission element D1. An initialization signal VINT for initializing a gate potential of driving transistor M1 to a predetermined potential is supplied to initialization signal line 2, which is connected to switch transistors M71 and M72. Gate electrodes of switch transistors M71 and M72 are connected to gate control signal line 205 and are controlled by gate control signal SCAN(n−1) at the same time. Also, switch transistors M21 and M22 are connected in series (or are diode-connected) between a gate electrode and a source electrode of driving transistor M1.

A gate electrode of connection transistor M3 and gate electrodes of emission transistors M4 and M6 are connected to emission control signal line 305, and are controlled by emission control signal EM(n) at the same time. In this embodiment, it is possible to compensate for a threshold value and to control light emitting. This circuit configuration may be referred to as a threshold value compensation circuit and may reduce influence due to variation in the threshold voltage Vth of driving transistor M1.

In FIG. 11, transistors M1, M21, M22, M3, M4, M5, M6, M71, and M72 may be p-channel transistors. Each of transistors M1, M21, M22, M3, M4, M5, M6, M71, and M72 may be selectively turned on or off by gate control signals SCAN(n−1) and SCAN(n) applied to its gate electrode and emission control signal EM(n). With the above description, a pixel is formed of six transistors and one capacitive element.

First, connection transistor M3 and emission transistor M4 and M6 are turned on in response to a low-to-high transition of emission control signal EM(n). Next, as a gate control signal SCAN(n−1) transitions to a low level, switch transistors M71 and M72 turn on. At this time, the gate potential of driving transistor M1 is reset to a potential of initialization signal line VINT.

Then, because gate control signal SCAN(n) transitions to a low level at the same time as gate control signal SCAN (n−1) transitions to a high level, switch transistors M5, M21, M22, M71, and M72 turn on at the same time. When transistor M5, M21, and M22 turn on, data signal DT on data signal line 405 is transferred to the gate electrode of driving transistor M1 via switch transistor M5, driving transistor M1, and switch transistors M21 and M22.

Based on the relationship between driving transistor M1 and switch transistors M21 and M22, switch transistors M21 and M22 are connected in series (i.e., diode-connected) between the gate electrode and a source/drain electrode of driving transistor M1 (or, connection between M1 and M4). In one embodiment, a low-to-high transition of gate control signal SCAN(n−1) coincides with a high-to-low transition of gate control signal SCAN(n). In another embodiment, gate control signal SCAN(n−1) transitions to a high level and gate control signal SCAN(n) transitions to a low level after a time.

After switch transistors M5, M21, and M22 are turned off in response to a low-to-high transition of gate control signal SCAN(n), connection transistor M3 and emission transistors M4 and M6 are turned on in response to a high-to-low transition of emission control signal EM(n). When connection transistor M3 is turned on, first nodes SM1 of adjacent pixels are connected to one another and second nodes SM2 are connected to one another. Also, first and second nodes SM1 and SM2 are connected to reference power supply voltage VDM.

Also, as emission transistors M4 and M6 are turned on, a current biased by a voltage corresponding to data value VDATA stored in capacitive element Cst is provided to emission element D1 from an anode power supply voltage ELVDD via emission transistor M6, driving transistor M1, and emission transistor M4. Thus, emission element D1 emits light.

The connection transistor M3 is turned off because emission control signal EM(n) has a high level during at least an initialization period and a data write period (e.g., a period where one of the gate control signal SCAN(n−1) or SCAN (n) has a low level, or a period where one of transistors M21, M22, M71, and M72 is turned on). At this time, first nodes SM1 of adjacent pixels are disconnected and second nodes SM2 are also disconnected.

In FIG. 11, a point in time when emission control signal EM(n) transitions to a high level is earlier than a point in time when gate control signal SCAN(n−1) is switched to a low level. Also, a point in time when emission control signal EM(n) transitions to a low level is later than a point in time when gate control signal SCAN(n) is switched into a high level.

In another embodiment, a low-to-high transition of emission control signal EM(n) may coincide with a high-to-low transition of gate control signal SCAN(n−1). Also, a high-to-low transition of emission control signal EM(n) may coincide with a low-to-high transition of gate control signal SCAN(n). In this embodiment, although switch transistors connected to the gate electrode of driving transistor M1 are affected by off leakage current, the first node SM1 and second node SM2 of pixel 10" are shorted, or first and second nodes SM1 and SM2 of pixel 10" are electrically connected to corresponding to nodes of an adjacent pixel, via connection transistor M3. Thus, although a plurality of switch transistors are connected to the gate electrode of driving transistor M1, the size of the pixel may be reduced and its opening ratio may be improved without additional control signal lines and transistors.

Figure 13:
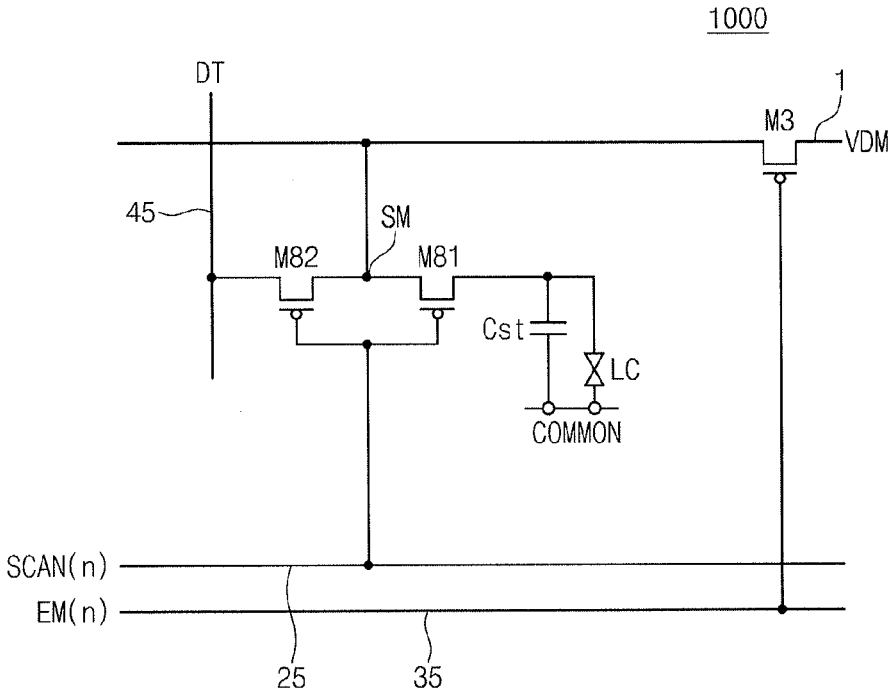
FIG. 13 illustrates another embodiment of a pixel.

FIG. 13 illustrates another embodiment of a pixel 1000 which includes data signal line 45, gate control signal line 25, capacitive element Cst having one electrode connected to a common electron COMMON, a liquid crystal capacitor LC having one electrode connected to a common electron COMMON, switch transistors M81 and M82 connected in series between the other electrode of the capacitive element Cst and data signal line 45, a connection transistor M3 connecting a node SM of the pixel and a node SM of an adjacent pixel, a reference power supply voltage VDM, and an emission control signal line 35 connected to a gate electrode of connection transistor M3.

The switch transistors M81 and M82 may be connected in series between the other electrode of the liquid crystal capacitor LC and data signal line 45. Thus, pixel 1000 is formed of three transistors and one capacitive element. The capacitance for storing data may include, but is not limited to, capacitive element Cst(m), parasitic capacitance of a switch transistor, and parasitic capacitance between various lines.

In an LCD, leakage current occurring at switch transistors M81 and M82 may cause variation in a potential stored in capacitive element Cst and variation in a voltage applied to liquid crystal capacitor LC. As a result, transmissivity of the liquid crystal capacitor LC may varied and thus brightness may change.

In this embodiment of the LCD, a potential variation of capacitive element Cst due to an off leakage current of the switch transistor is suppressed using a small number of addition elements and lines. Because the size of a capacitive element of the data storage capacitor is markedly scaled down, opening ratio may be improved and small pixel size may be realized. A method of operating a pixel shown in FIG. 13 may be similar to that shown in FIG. 2.

In one or more of the aforementioned embodiments, if a node (e.g., node SM between transistors M21 and M22, a node SM between transistors M71 and M72, or a node SM between transistors M81 and M82) of switch transistors of adjacent pixels are connected to a reference power supply voltage VDM, the potential of node SM is equalized to potentials of all connected nodes among adjacent pixels. As a result, it is possible to reduce a potential difference between a source electrode and drain electrode of the switch transistor connected directly to a gate electrode of the driving transistor. Thus, it is possible to suppress variation in a gate voltage of the driving transistor and variation in brightness, and also flicker phenomenon due to threshold voltage variation of the driving transistor.

In FIGS. 2, 8, and 11, nodes among adjacent pixels are connected in a direction of a gate control signal line. In other embodiments, nodes among adjacent pixels disposed in a direction of a data signal line may be connected to one another. In this case, driving may be performing during a write (non-emission) period and an emission period of one frame, e.g., simultaneous driving may be performed. Connection transistor M3 may be turned off during at least the non-emission period. Afterwards, connection transistor M3 may be turned on during at least a portion of the emission period.

The aforementioned pixel embodiments are implemented using p-channel transistors. In other embodiments, pixel may be implemented using n-channel transistors, or n-channel and p-channel transistors (CMOS type).

Also, in pixel circuits of one or more of the aforementioned embodiments, a data signal line and an initialization signal line are described as a signal line for connection with a data storage capacitor, via a switch transistor. In other embodiments, the same effect may be obtained when a signal line is used to which a voltage different from a voltage applied to the data storage capacitor is supplied in at least a period.

By way of summation and review, in the related art, gray scale data may be used to control the brightness of light to be emitted from pixels. Once written, the gray scale data may be retained until next gray scale data is to be written. If leakage current occurs at a pixel transistor, the voltage applied to the pixel may vary with time. As a result, a flicker phenomenon may occur or a variation in brightness of the pixel may result.

Various attempts have been made to reduce off leakage current. However, these attempts have proven insufficient because charges accumulated by parasitic capacitance may move as a result of leakage current of transistors in the off state. This leakage current changes the gray scale data to be written in the pixels and thus degrades display quality.

In accordance with one or more of the aforementioned embodiments, gray scale variation of a pixel caused by leakage current of one or more switch transistors may be reduced or eliminated using a small number of additional elements and lines. Also, because the size of a capacitive element of a data storage capacitor is markedly scaled down, the layout size of pixels in a display area may reduced, opening ratio may be improved, and a reduction in overall size may be achieved.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A pixel circuit, comprising:

a plurality of pixels each including:

a data storage capacitor to store a voltage for controlling a gray scale value based on an input data signal, a plurality of switch transistors connected in series between a data signal line and the data storage capacitor, each of the switch transistors including a gate electrode connected to a first gate control signal line; and a plurality of connection transistors coupled to the pixels, wherein at least one of the connection transistors is connected between at least one node between the switch transistors of a first pixel and at least one node between the switch transistors of a second pixel adjacent to the first pixel, and wherein the at least one connection transistor includes a gate electrode connected to a second gate control signal line.

2. The pixel circuit as claimed in claim 1, wherein the at least one node of each of the first and second pixels is connected to a power supply voltage line having a predetermined voltage via respective ones of the connection transistors.

3. The pixel circuit as claimed in claim 1, wherein each of the first and second pixels includes:

a driving transistor having a gate electrode to receive a voltage charged in the data storage capacitor, the driving transistor to adjust an amount of input current to be supplied to an emission element; and an emission transistor connected between the driving transistor and emission element and controlled with connection transistor, the emission transistor to control the input current to be supplied to the emission element, wherein the plurality of switch transistors includes a first switch transistor connected between a first signal line and the data storage capacitor, and a second switch transistor connected between a second signal line and the data storage capacitor, wherein the first and second switch transistors are connected to the at least one node, and wherein the connection transistor is turned off during a turn-on period of the first and second switch transistors and is turned on during at least a period after the first and second switch transistors are turned off.

4. A method of driving a display device, the method comprising:

turning on switch transistors of a first pixel after a connection transistor of the first pixel is turned off; and turning on the connection transistor after the switch transistors are turned off, wherein the switch transistors are coupled in series between a driving transistor and a data line of the first pixel, wherein the connection transistor is coupled to a node between the switch transistors of the first pixel and a node between switch transistors of a second pixel adjacent the first pixel.

5. The method as claimed in claim 4, wherein the nodes of the first and second pixels are connected to a power supply voltage line having a predetermined voltage during a turn-on period of the connection transistor.

6. The method as claimed in claim 4, wherein the nodes of the first and second pixels are connected to a power supply voltage line having a predetermined voltage via the connection transistor.

7. The method as claimed in claim 4, wherein each of the first and second pixels includes:

a driving transistor having a gate electrode to receive a voltage charged in a data storage capacitor, the driving transistor to adjust an amount of input current to be supplied to an emission element; and an emission transistor connected between the driving transistor and the emission element and controlled with the connection transistor, the emission transistor controlling the input current to be supplied to the emission element, wherein the emission transistor is turned on with the switch transistors and is turned off with the switch transistors.

8. The method as claimed in claim 4, wherein:

the switch transistors in the first pixel includes a first switch transistor connected between a first signal line and a data storage capacitor, and a second switch transistor connected between a second signal line and the data storage capacitor, the first and second switch transistors are connected to the node of the first pixel, and the first switch transistor is turned on after the connection transistor is turned off, the second switch transistor is turned on after the first switch transistor is turned off, and the connection transistor is turned on after the second switch transistor is turned off.

9. A pixel, comprising:

a first transistor coupled between a node and an emission area; and a second transistor coupled between the node and a data line, wherein the first and second transistors are controlled by a control signal, wherein the node is coupled to a reference power supply voltage when the control signal has a first value and is not coupled to the reference power supply voltage when the control signal has a second value, and wherein leakage current of at least one of the first or second transistors is controlled by the reference power supply voltage when the first and second transistors are set to an off state by the first value of the control signal.

10. The pixel as claimed in claim 9, wherein the emission area includes:

an organic light emitting diode; and a driving transistor to control the organic light emitting diode.

11. The pixel as claimed in claim 9, wherein the emission area includes a liquid crystal layer.

12. The pixel as claimed in claim 9, wherein the node is coupled to a node between switch transistors of another pixel.

13. The pixel as claimed in claim 9, wherein the reference power supply voltage is based on an average of data values to be written into at least two pixels.

14. A pixel circuit, comprising:

a first pixel;

a second pixel adjacent to the first pixel; and a connection transistor between the first and second pixels, wherein each of the first and second pixels includes a first transistor coupled between a node and an emission area and a second transistor coupled between the node and a data line, wherein the first and second transistors are controlled by a first control signal and the connection transistor is controlled by a second control signal, and wherein the node of the first pixel is coupled to the node of the second pixel through the connection transistor, and the node of the second pixel is coupled to a reference power supply voltage.

15. The pixel circuit as claimed in claim 14, wherein, in each of the first and second pixels, leakage current of at least one of the first or second transistors is controlled by the reference power supply voltage when the first and second transistors are set to an off state by the first control signal.

16. The pixel circuit as claimed in claim 14, wherein:

the first control signal is a scan signal, and the second control signal is an emission signal.

17. The pixel circuit as claimed in claim 14, wherein, in each of the first and second pixels, the first and second transistors are in an off state when the connection transistor is in an on state.

18. The pixel circuit as claimed in claim 14, wherein the emission area of each of the first and second pixels includes:

an organic light emitting diode; and a driving transistor to control the organic light emitting diode.

19. The pixel circuit as claimed in claim 14, wherein the emission area of each of the first and second pixels includes a liquid crystal layer.

20. The pixel circuit as claimed in claim 14, wherein the reference power supply voltage is based on an average of data values to be written in at least the first and second pixels.

* * * * *